US007549835B2

(12) United States Patent
Brillert

(10) Patent No.: US 7,549,835 B2
(45) Date of Patent: Jun. 23, 2009

(54) LEAKAGE FLOW CONTROL AND SEAL WEAR MINIMIZATION SYSTEM FOR A TURBINE ENGINE

(75) Inventor: Dieter Brillert, Rodgau (DE)

(73) Assignee: Siemens Energy, Inc., Orlando, FL (US)

( * ) Notice: Subject to any disclaimer, the term of this patent is extended or adjusted under 35 U.S.C. 154(b) by 0 days.

(21) Appl. No.: 11/482,610

(22) Filed: Jul. 7, 2006

(65) Prior Publication Data

US 2008/0008574 A1 Jan. 10, 2008

(51) Int. Cl.
*F01D 11/00* (2006.01)

(52) U.S. Cl. ..... 415/1; 415/131; 415/174.1; 415/174.2; 415/174.4; 415/174.5; 415/230; 415/231; 277/413

(58) Field of Classification Search ..... 415/1, 415/126, 128, 131, 132, 138, 173.1, 173.2, 415/173.3, 173.4, 173.5, 173.7, 174.1, 174.2, 415/174.3, 174.4, 174.5, 230–231; 277/411–413
See application file for complete search history.

(56) References Cited

U.S. PATENT DOCUMENTS

| | | | | |
|---|---|---|---|---|
| 4,230,324 | A | 10/1980 | Derman | |
| 4,330,234 | A | 5/1982 | Colley | |
| 4,754,983 | A | 7/1988 | Kruger | |
| 5,203,673 | A * | 4/1993 | Evans | 415/173.2 |
| 5,498,139 | A | 3/1996 | Williams | |
| 5,613,829 | A * | 3/1997 | Wolfe et al. | 415/174.1 |
| 5,688,105 | A | 11/1997 | Hoffelner | |
| 5,971,704 | A | 10/1999 | Blattmann | |
| 6,092,986 | A | 7/2000 | Oeynhausen et al. | |
| 6,273,671 | B1 | 8/2001 | Ress, Jr. | |
| 6,609,882 | B2 * | 8/2003 | Urlichs | 415/230 |
| 6,672,831 | B2 | 1/2004 | Brandl et al. | |
| 6,676,372 | B2 | 1/2004 | Scholz et al. | |
| 6,692,222 | B2 | 2/2004 | Prinz et al. | |
| 6,739,829 | B2 | 5/2004 | Addie | |
| 2002/0009361 | A1 | 1/2002 | Reichert et al. | |
| 2002/0164246 | A1 * | 11/2002 | Scholz et al. | 415/134 |
| 2004/0057826 | A1 | 3/2004 | Haje | |
| 2005/0069406 | A1 | 3/2005 | Turnquist et al. | |

FOREIGN PATENT DOCUMENTS

| | | |
|---|---|---|
| WO | WO 01/31169 A1 | 5/2001 |

* cited by examiner

*Primary Examiner*—Christopher Verdier

(57) ABSTRACT

A system and method for extending seal life and for reducing leakage flow in a turbine engine is directed to an interface defined between a stationary component and a rotating component. A seal, which can be a flexible seal such as a brush seal, can be operatively attached to the stationary component. The rotating component has a first region at a first radius relative to the axis of rotation that transitions into a second region at a second, larger radius relative to the axis of rotation. In one embodiment, the rotating component can be selectively axially moved between a first position and a second position. In the first position, the seal is disposed over the first region so as to define a clearance. In the second position, the seal is disposed over the second region so as to decrease the size of the clearance.

17 Claims, 6 Drawing Sheets

LEAKAGE FLOW CONTROL AND SEAL WEAR MINIMIZATION SYSTEM FOR A TURBINE ENGINE

FIELD OF THE INVENTION

The invention relates in general to turbine engines and, more particularly, to a system for minimizing leakage flow in a turbine engine.

BACKGROUND OF THE INVENTION

FIG. 1 shows a cross-section through a portion of a turbine engine 10. The turbine engine 10 can generally include a compressor section 12, a combustor section 14 and a turbine section 16. A centrally disposed rotor 18 can extend through the three sections.

The turbine section 16 can include alternating rows of stationary airfoils 20 (commonly referred to as vanes) and rotating airfoils 22 (commonly referred to as blades). Each row of blades can include a plurality of airfoils 22 attached to a disc 24 provided on the rotor 18. The rotor 18 can include a plurality of axially-spaced discs 24. The blades 22 can extend radially outward from the discs 24.

Each row of vanes can be formed by attaching a plurality of airfoils 20 to the stationary support structure in the turbine section 16. For instance, the airfoils 20 can be hosted by a vane carrier 26 that is attached to the outer casing 28. The vanes 20 can extend radially inward from the vane carrier 26 or other stationary support structure to which they are attached and terminate in a region referred to as the vane tip 30.

In operation, the compressor section 12 can induct ambient air and can compress it. The compressed air 32 from the compressor section 12 can enter a chamber 34 enclosing the combustor section 12. The compressed air 32 can then be distributed to each of the combustors 36 (only one of which is shown). In each combustor 36, the compressed air 32 can be mixed with the fuel. The air-fuel mixture can be burned to form a hot working gas 38. The hot gas 38 can be routed to the turbine section 16: As it travels through the rows of vanes 20 and blades 22, the gas 38 can expand and generate power that can drive the rotor 18. The expanded gas 40 can then be exhausted from the turbine 16.

However, there are a number of places in which leakage of the gas 38 can occur in the turbine section 16. Such leakage can result in measurable engine performance decreases in power and efficiency. One area in which such leakage can occur is at interface 41 between the vanes 20 and the neighboring rotating structure. One known system for minimizing such leakage is by the use of a brush seal. An example of a known brush seal system is shown in FIG. 2. One or more brush seals 42 can be operatively attached to the vane 20, such as by a seal housing 44 attached to the vane 20 in the tip region 30. The seals 42 can extend radially inward from the seal housing 44. The seals 42 can be in close proximity to the neighboring rotating components, such as axial extensions 46 provided on the discs 24. A clearance C can be defined between the brush seals 42 and the disc extensions 46.

However, the rotating and stationary components of the turbine section 16 radially expand and contract at different rates when the engine is operating under transient conditions. For instance, when the engine is restarted soon after shutdown, which is sometimes referred to as a hot restart, the rotating components can grow radially outward at a faster rate than the stationary components. This differential in radial growth can be attributed to the faster thermal response of the rotating components and to the centrifugal forces acting on the rotating components. As a result, the clearance C can reduce to zero or less, and the brush seals 42 can rub against the disc extensions 46. Though the brush seals 42 can withstand such rubbing contact, extensive wearing of the brush seals 42 can occur such that the brush seals 42 become shorter. Consequently, the clearance C may become overly large when the engine reaches steady state operation, which, in turn, can have a detrimental effect on engine performance. Further, the brush seals 42 may require more frequent outages for service and/or replacement, thereby introducing significant costs over the life of the engine. Thus, there is a need for a system that can minimize such concerns.

SUMMARY OF THE INVENTION

Aspects of the invention are directed to a leakage flow control system. The system includes a stationary turbine engine component, such as a turbine vane, and a seal operatively attached to the stationary turbine engine component. The seal can be, for example, a flexible seal or a brush seal. The system further includes a turbine engine component rotatable about an axis of rotation. The rotatable turbine engine component has an outer peripheral surface that includes a first region at a first radius relative to the axis of rotation. The first region transitions into a second region at a second radius relative to the axis of rotation. The second radius is greater than the first radius. The rotatable component can further include a transition region between the first and second regions. The transition region can be a flare from about 5 degrees to about 40 degrees relative to the axis of rotation. In one embodiment, the flare can be about 15 degrees relative to the axis of rotation. Alternatively, the transition region can be one or more steps. The term "about" used throughout this application is meant to be ±10% of the stated value, unless otherwise stated.

The rotating turbine engine component and/or the stationary turbine engine component are selectively axially movable between a first position and a second position. In the first position, the seal is disposed over the first region so that a first clearance is defined therebetween. In the second position, the seal is disposed over the second region so that a second clearance is defined therebetween. The second clearance is less than the first clearance.

Another leakage flow control system according to aspects of the invention includes a turbine vane with a brush seal operatively attached to the turbine vane. The system further includes a rotor that has an axis of rotation. A component, such as a rotor disc or an axial extension of a rotor disc, is operatively attached to the rotor. The component has an outer peripheral surface that includes a first region at a first radius relative to the axis of rotation. The first region transitions into a second region at a second radius relative to the axis of rotation. The second radius is greater than the first radius. There can be a transition region between the first and second regions. In one embodiment, the transition region can be a flare from about 5 degrees to about 40 degrees relative to the axis of rotation. For instance, the flare can be about 15 degrees relative to the axis of rotation. Alternatively, the transition region can be one or more steps.

The rotor is selectively axially movable between at least a first position and a second position. In the first position, the brush seal is disposed over the first region so that a first clearance is defined therebetween. In the second position, the brush seal is disposed over the second region so that a second clearance is defined therebetween. The second clearance is less than the first clearance.

In another respect, aspects of the invention are directed to a method of minimizing leakage flow in a turbine engine. The method includes the step of providing a stationary turbine engine component with a seal, such as a brush seal, operatively attached to the stationary turbine engine component. Also provided is a turbine engine component rotating about an axis of rotation. The rotating turbine engine component has an outer peripheral surface that includes a first region at a first radius relative to the axis of rotation. From the first region, the outer peripheral surface transitions into a second region at a second radius relative to the axis of rotation. The second radius is greater than the first radius.

The stationary and rotating turbine engine components define an interface. The interface is in a first position in which the seal is disposed over the first region so that a first clearance is defined therebetween. The interface is selectively moved into a second position in which the seal is disposed over the second region so that a second clearance is defined therebetween. The second clearance is less than the first clearance. The method can further include the step of selectively returning the interface to the first position.

The step of selectively moving the interface can occur upon the occurrence of a predetermined operational parameter, such as steady state engine operation. The selectively moving step can be performed by axially moving the stationary turbine engine component and/or by axially moving the rotating turbine engine component.

DETAILED DESCRIPTION OF EMBODIMENTS OF THE INVENTION

Aspects of the present invention relate to a system and method for extending seal life and for reducing leakage flow in a turbine engine. Embodiments of the invention will be explained in connection with the potential leakage flow path between a turbine vane and the neighboring rotating structures, but the detailed description is intended only as exemplary. Embodiments of the invention are shown in FIGS. 3-6, but aspects of the invention are not limited to the illustrated structure or application.

Figure 1:
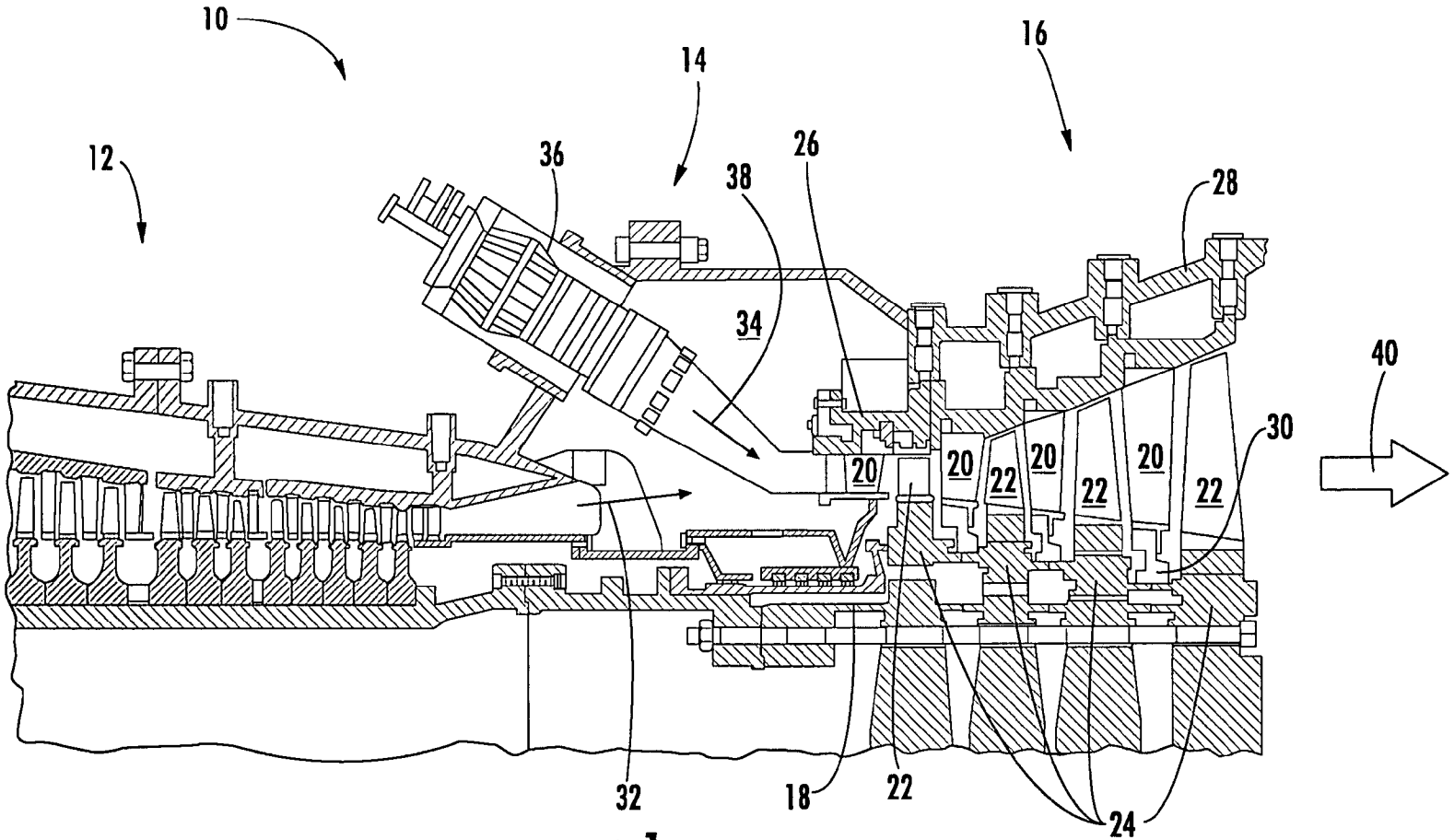
FIG. 1 (PRIOR ART)
FIG. 1 is a cross-sectional view through a portion of a known turbine engine.
Figure 2:
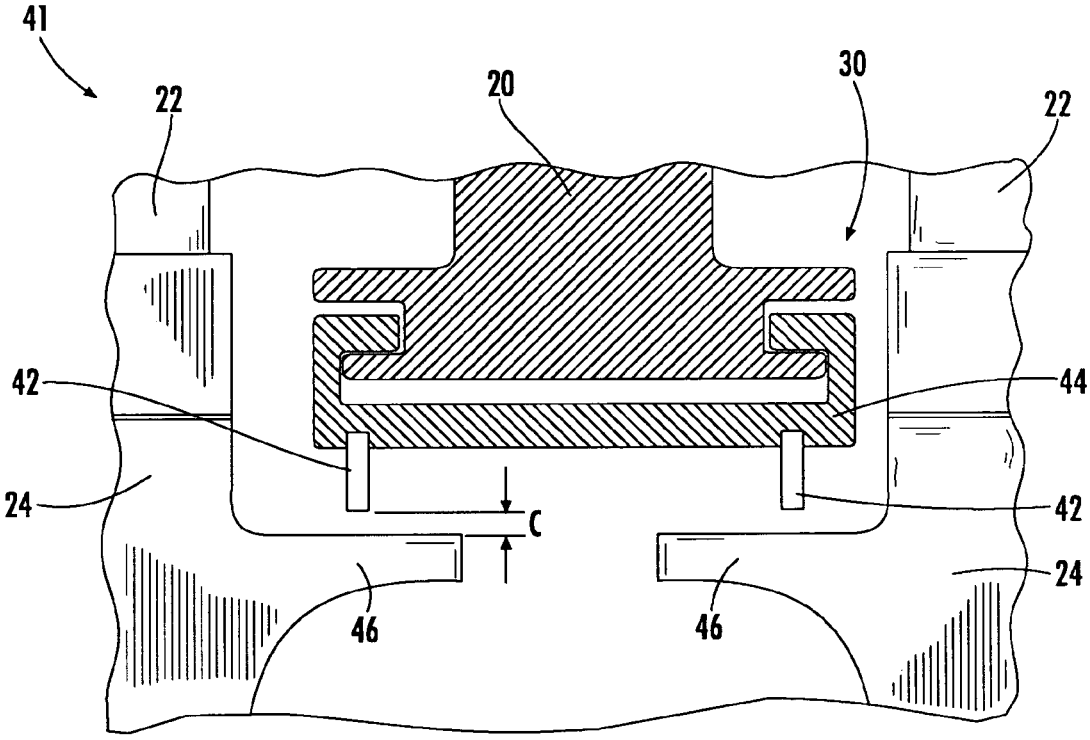
FIG. 2 (PRIOR ART)
FIG. 2 is a close-up cross-sectional view of a portion of a known turbine engine, showing a known interface between a tip region of a turbine vane and the neighboring rotor discs.
Figure 3:
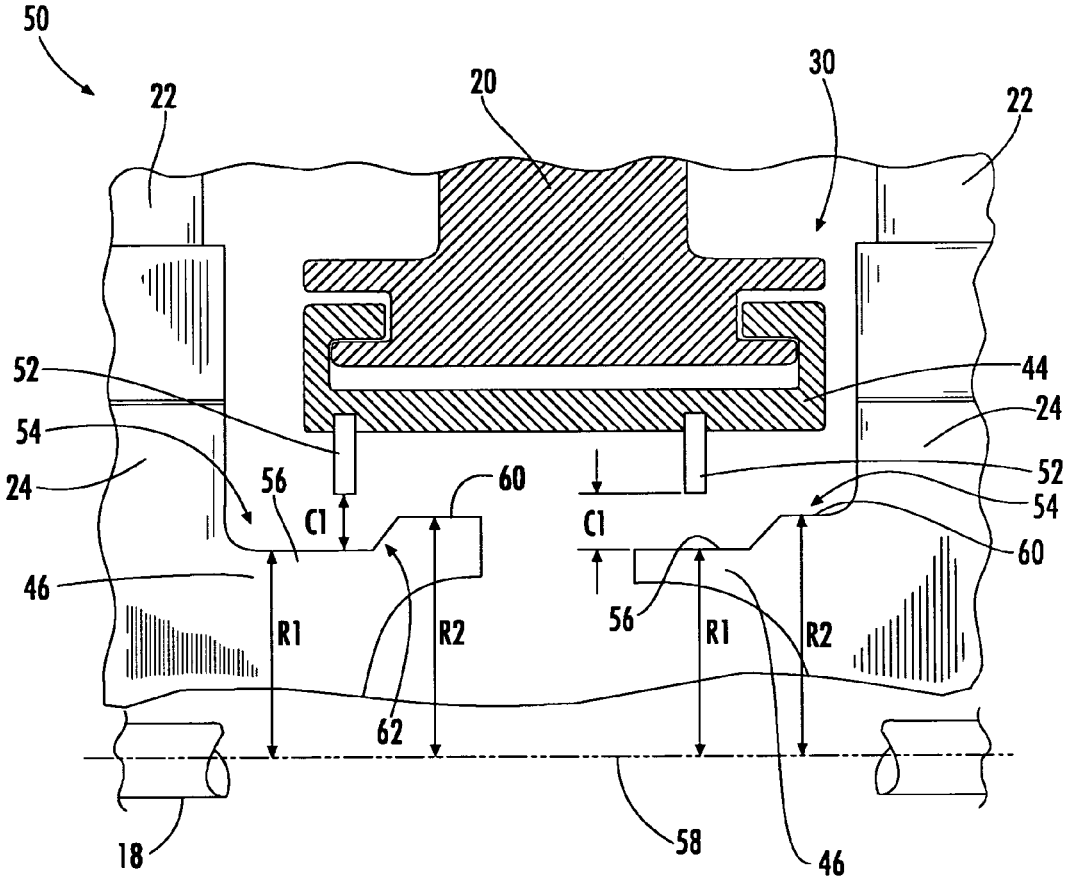
FIG. 3 is a cross-sectional view of an interface between the tip region of a turbine vane and the neighboring rotating turbine components according to aspects of the invention, wherein the interface is in a first position.

A system according to aspects of the invention can be used in connection with an interface between rotating and stationary turbine components. FIG. 3 shows an interface 50 between a rotating disc 24 and a vane 20 in which the interface 50 is configured according to aspects of the invention. A seal can be operatively attached to the vane 20 in any suitable manner. For example, the seal can be attached to the vane 20 by a housing 44 that can be attached to a tip region 30 of the vane 20. Alternatively, the seal can be attached directly to the vane 20.

The seal can be a substantially 360 degree ring, or it can comprise a plurality of segments that collectively form a ring. In one embodiment, the seal can be a brush seal 52. While well-suited for an interface that includes a brush seal, aspects of the invention are not limited to brush seals and can be applied to an interface having any of a number of seals. For instance, the seal can be a felt metal seal, a honeycomb seal, a seal made of a flexible or compliant material, a knife edge seal, or a seal made of a non-flexible material.

According to aspects of the invention, the rotating components can be configured to minimize fluid leakage and to prolong brush seal life. FIG. 3 shows one system according to aspects of the invention in which one or more axial extensions 46 of the rotor discs 24 are adapted in accordance with aspects of the invention. It should be noted that the axial extension 46 can be a part of the disc 24 itself, or the axial extension 46 can be provided on a cover (not shown) attached to the disc 24.

An outer peripheral surface 54 of the axial extension 46 includes a first region 56 at a first radius R1 relative to a longitudinal axis 58 of the rotor 18 and a second region 60 at a second radius R2 relative to the axis 58 of the rotor 18. The second radius R2 is larger than the first radius R1. The first and second radii R1, R2 can be sized as appropriate, depending on the engine system. In one embodiment, the difference between the first and second radii R1, R2 can be up to about 15 millimeters. In another embodiment, the difference between the first and second radii R1, R2 can be from about 3 millimeters to about 5 millimeters.

The outer peripheral surface 54 of the axial extension 46 can include a transition region 62 between the first and second regions 56, 60. The transition region 62 can have any of a number of forms. For instance, the outer peripheral surface 54 of the axial extension 46 can be flared or stepped in the transition region 62. In one embodiment, the outer peripheral surface 54 of the axial extension 46 can flare radially outward at about 25 degrees to about 40 degrees relative to the axis 58 of the rotor 18 in the transition region 62. More particularly, the outer peripheral surface 54 of the axial extension 46 can flare radially outward at about 30 degrees relative to the axis 58 of the rotor 18 in the transition region 62. In other embodiments, the transition between the first region 56 and the second region 60 can be more abrupt, such as by a single, substantially 90 degree step. Preferably, the transition region 62 is configured so that sharp edges are avoided.

FIG. 3 shows an example in which there is a plurality of axial extensions 46 configured in accordance with aspects of the invention. In such case, the axial extensions 46 can be substantially identical to each other. That is, the first region 56 and the first radius R1, the second region 60 and the second radius R2, and the transition region 62 can be the same for each axial extension 46. However, the axial extensions 46 can be different from each other in one or more respects. In one embodiment, only one of the axial extensions 46 can be configured in accordance with aspects of the invention.

As shown in FIG. 3, the interface 50 can be in a first position in which the brush seal 52 is disposed over at least a portion of the first region 56. When the interface 50 is in the first position, a first clearance C1 can be defined between the brush seal 52 and the first region 56. Ideally, the first clearance C1 is sized so that the will be no contact between the brush seal 52 and the first region 56 for any expected engine operating condition. From a cold engine start-up condition, the interface 50 can be in the first position. The interface 50 can remain in the first position during part-load engine operation or otherwise under transient operational conditions.

Figure 4:
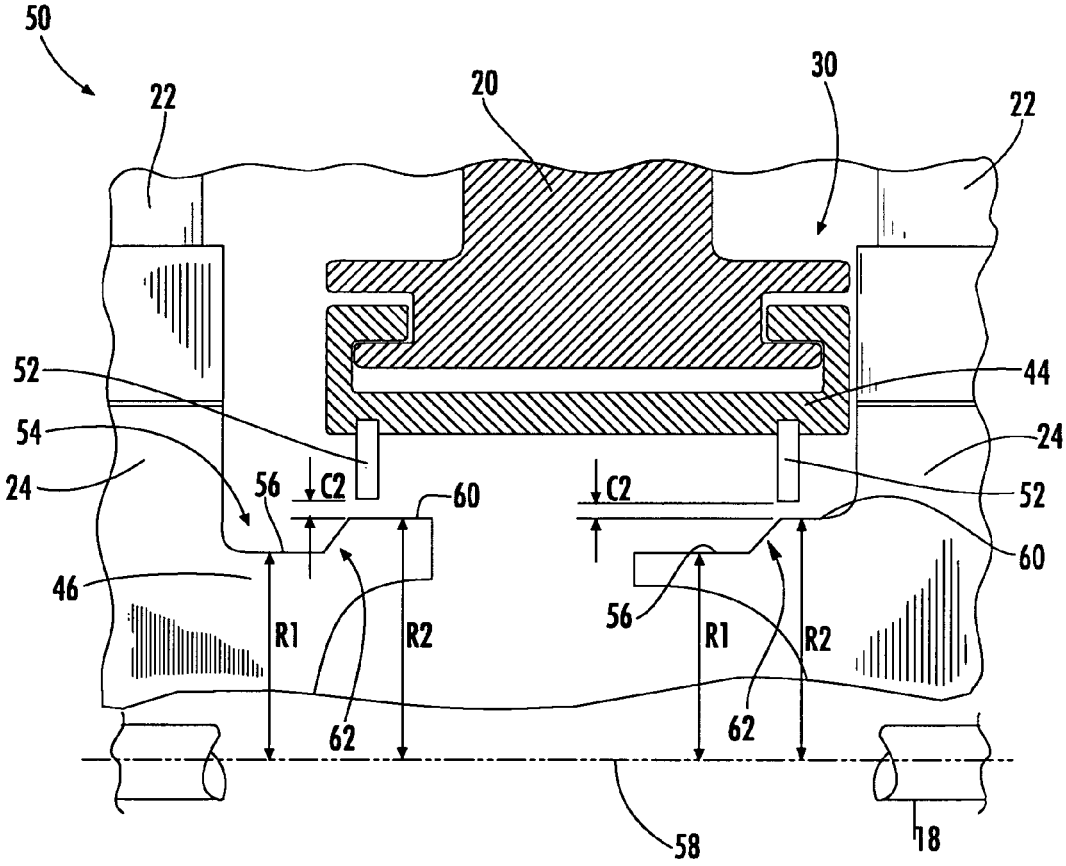
FIG. 4 is a cross-sectional view of the interface of FIG. 3, wherein the interface is in a second position.

During engine operation, it may be desirable to reduce the clearance C1 so as to minimize fluid losses through the clearance C1. According to aspects of the invention, the rotating components and/or the stationary components can be selectively moved so that the interface 50 is moved into a second position in which the brush seal 52 is disposed over at least a portion of the second region 60 of the axial extension 46, as shown in FIG. 4. When the interface 50 is in the second position, a second clearance C2 can be defined between the brush seal 52 and the second region 60. The second clearance C2 can be less than the first clearance C1 so as to reduce leakage flow through the interface 50 and to increase engine performance. Preferably, the second clearance C2 is sized to be as small as possible. In one embodiment, the clearance C2 may be less than zero so that the brush seal 52 and the second region 60 rub during engine operation. The brush seal 52 can be flexible enough to withstand the rubbing, which can wear the brush seal 52 to an appropriate length with respect to the second region 60.

Relative movement between the stationary and rotating components can be achieved in various ways. In one embodiment, at least some of the rotating components defining the clearance can be axially moved. For example, U.S. Patent Application Publication No. 2002/0009361 A1, which is incorporated herein by reference, discloses a system for selectively axially moving a turbine engine rotor. As a result, any of the components operatively attached to the rotor (discs, axially extensions, disc cover plates, etc.) are axially moved as well.

Alternatively, at least some of the stationary components defining the clearance can be axially moved. For instance, U.S. Pat. No. 6,676,372, which is incorporated herein by reference, teaches a system in which a vane carrier can be selectively axially moved. Naturally, such axial movement causes the vanes attached to the vane carrier to also be moved in the axial direction. Yet another possibility according to aspects of the invention is for both the stationary and rotating components to be axially moved so as to bring the interface 50 to the second position. The teachings of U.S. Pat. No. 6,676,372 and U.S. Patent Application Publication No. 2002/0009361 A1 can be combined to achieve such movement.

The interface 50 can be moved into the second position upon the occurrence of one or more operational parameters. For instance, the operational parameter can be steady state engine operation, such as at base load, where all of the components that form the interface have thermally grown to their final shapes. The operational parameter can also be at any engine condition where improved performance is desired.

The interface 50 can remain in the second position for as long as desirable or until the occurrence of a second operational parameter. For example, the interface 50 can be returned to the first position when the engine is shut down or under non-standard engine operating conditions. Alternatively, the interface 50 can be returned to the first position to minimize wear of the brush seal 52.

Figure 5:
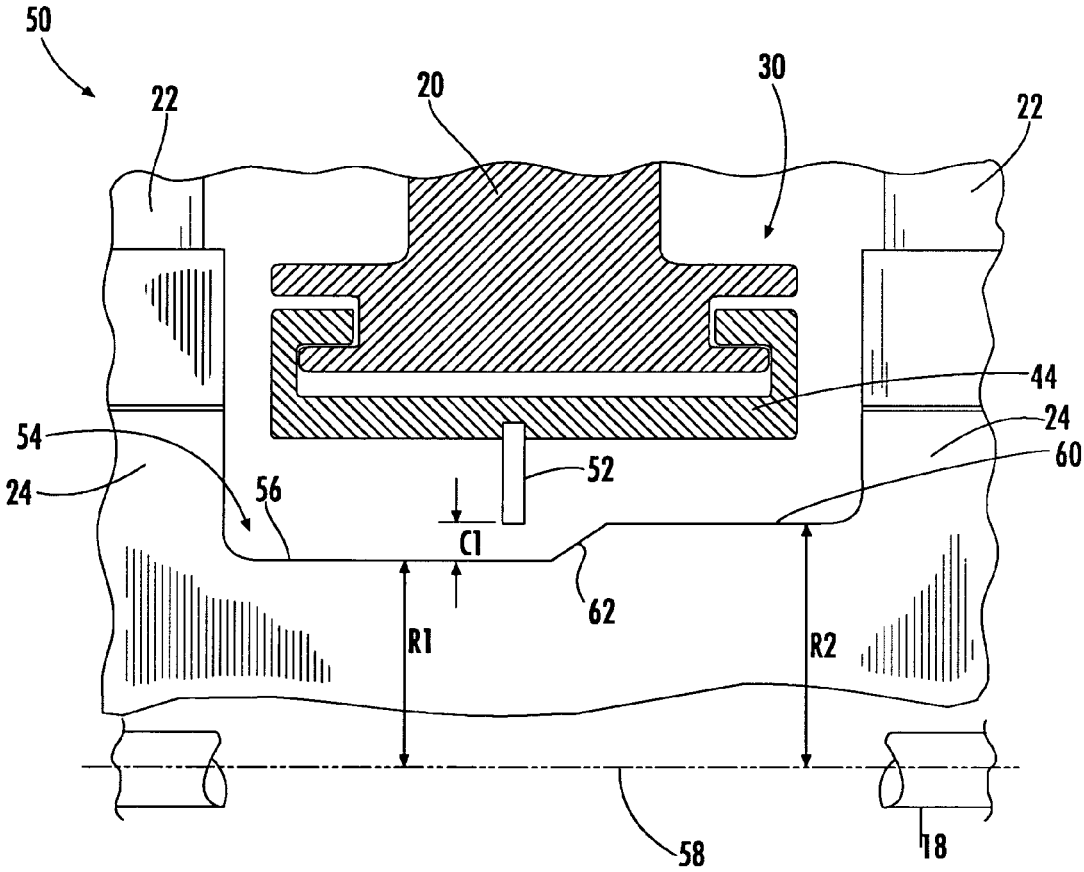
FIG. 5 is a cross-sectional view of an alternative interface between the tip region of a turbine vane and the neighboring rotating turbine components according to aspects of the invention, wherein the interface is in a first position.
Figure 6:
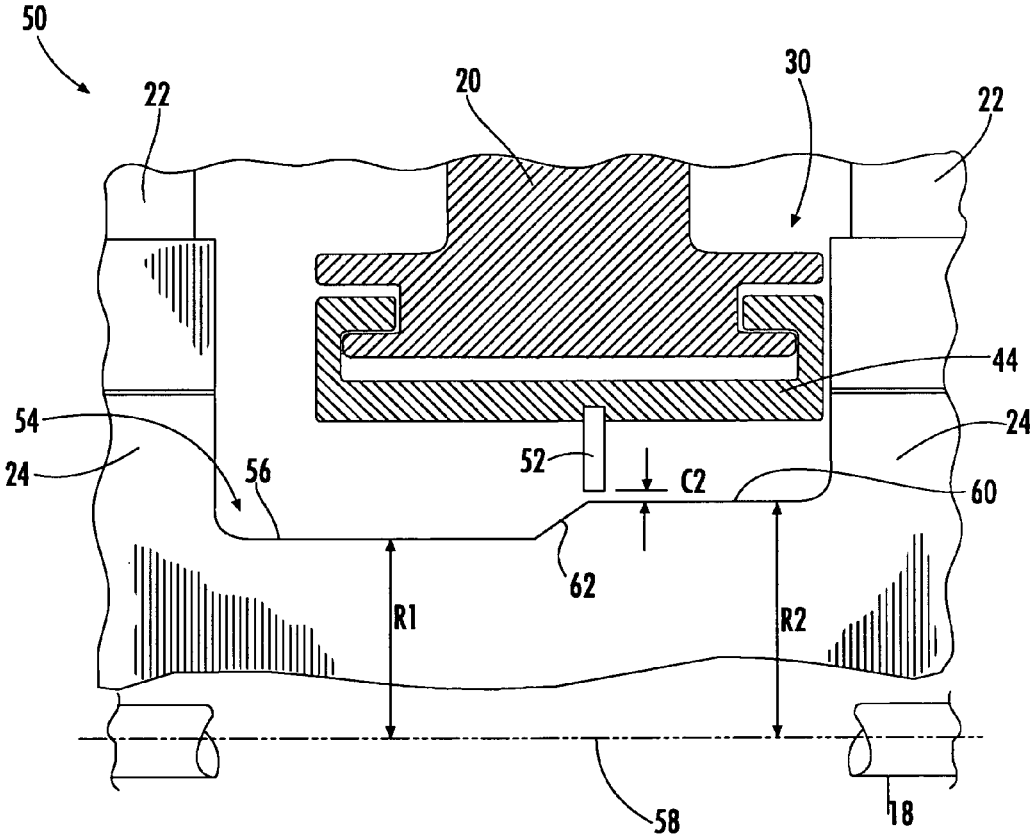
FIG. 6 is a cross-sectional view of the interface of FIG. 5, wherein the interface is in a second position.

It should be noted that aspects of the invention are not limited to embodiments in which the clearance is defined in part by the outer peripheral surface 54 of the axial extension 46. Rather, clearance can be defined between the stationary seal and any rotating component. The rotating component can be a disc, mini-disc, the rotor itself, other rotating components or any combination thereof. FIG. 5 shows an alternative interface 50 in the first position in which the first clearance C1 is defined between the brush seal 52 and the first region 56 of a disc 24. FIG. 6 shows the interface 50 in the second position in which the second clearance C2 is defined between the brush seal 52 and the second region 60 of the disc 24. The previous discussion of these components and the manner in which relative movement can be achieved applies equally here.

It will be appreciated that the aspects of the invention can minimize the amount of contact between a seal and the neighboring rotating turbine components during engine operation. While the aspects of the invention may not completely eliminate all instances of seal rubbing, the duration and overall amount of such rubbing can be reduced. Naturally, the brush seals will wear at a much more gradual rate such that the life expectancy of the brush seals can be prolonged. The brush seals will require less maintenance and replacement over the life of the engine, thereby minimizing outages. Thus, the system and method according to aspects of the invention can yield appreciable life cycle cost reductions.

Further, aspects of the invention can maintain or improve engine performance and efficiency by actively controlling fluid leakage through the clearance. According to one analytical model, a system according to aspects of the invention can reduce the leakage flow at the interface by about 0.5 percent to about one percent of the compressor inlet flow. One engine study shows a 0.6 percent reduction in leakage flow compared to an interface that does not use brush seals.

The foregoing description is provided in the context of various possible systems for extending brush seal life and/or improving engine efficiency and performance. While especially suited for minimizing the clearance between a vane and the neighboring rotating turbine components, aspects of the invention can be applied to any and all potential leakage areas between stationary and rotating components in the turbine section. Moreover, aspects of the invention can be applied to leak paths in other portions of a turbine engine, such as in the compressor section. However, the most significant benefits of aspects of the invention can be gained in the turbine section of the engine. Thus, it will of course be understood that the invention is not limited to the specific details described herein, which are given by way of example only, and that various modifications and alterations are possible within the scope of the invention as defined in the following claims.

What is claimed is:

1. A leakage flow control system comprising:

a stationary turbine engine component;

a seal operatively attached to the stationary turbine engine component; and a turbine engine component rotatable about an axis of rotation, the rotatable turbine engine component having an outer peripheral surface that includes a first region at a first radius relative to the axis of rotation that transitions into a second region at a second radius relative to the axis of rotation, the second radius being greater than the first radius, the turbine engine component further including a transition region between the first and second regions, wherein the transition region is a flare, wherein at least one of the rotating turbine engine component and the stationary turbine engine component is selectively axially movable between a first position and a second position, wherein, in the first position, the seal is disposed over the first region so that a first clearance is defined therebetween, wherein, in the second position, the seal is disposed over the second region so that a second clearance is defined therebetween, the second clearance being less than the first clearance.

2. The system of claim 1 wherein stationary component is a turbine vane.

3. The system of claim 1 wherein the flare is from about 5 degrees to about 40 degrees relative to the axis of rotation.

4. The system of claim 3 wherein the flare is about 15degrees relative to the axis of rotation.

5. The system of claim 1 wherein the seal is a flexible seal.

6. The system of claim 1 wherein the seal is a brush seal.

7. A leakage flow control system comprising:

a turbine vane having a tip region;

a seal holder attached to the tip region of the turbine vane;

a first brush seal attached to the seal holder, the first brush seal extending generally radially inward from the seal holder;

a rotor having an axis of rotation, the rotor being selectively axially movable between at least a first position and a second position;

a first disc provided on the rotor, the first disc having a protrusion extending in a generally axially downstream direction relative to a flow direction of fluid through the system, the protrusion having an outer peripheral surface that includes a first region at a first radius relative to the axis of rotation that transitions into a second region at a second radius relative to the axis of rotation, the second radius being greater than the first radius; and a plurality of turbine blades attached to the first disc, the plurality of blades being upstream of the turbine vane relative to a flow direction of fluid through the system, wherein, in the first position, the first brush seal is disposed over the first region so that a first clearance is defined therebetween, wherein, in the second position, the first brush seal is disposed over the second region so that a second clearance is defined therebetween, the second clearance being less than the first clearance, a second brush seal attached to the seal holder, the second brush seal extending radially inward from the seal holder, the second brush seal being located axially downstream of the first brush seal;

a second disc provided on the rotor, the second disc being axially downstream of the first disc, the second disc having a protrusion extending in a generally axially upstream direction relative to a flow direction of fluid through the system, the protrusion having an outer peripheral surface that includes a first region at a third radius relative to the axis of rotation that transitions into a second region at a fourth radius relative to the axis of rotation, the fourth radius being greater than the third radius; and a plurality of turbine blades attached to the second disc, the plurality of blades being downstream of the turbine vane relative to a flow direction of fluid through the system;

wherein, in the first position, the second brush seal is disposed over the first region of the protrusion on the second disc so that a third clearance is defined therebetween, wherein, in the second position, the second brush seal is disposed over the second region of the protrusion on the second disc so that a fourth clearance is defined therebetween, the fourth clearance being less than the third clearance.

8. The system of claim 7 further including a transition region between the first and second regions, wherein the transition region is a flare from about 5 degrees to about 40 degrees relative to the axis of rotation.

9. The system of claim 8 wherein the flare is about 15 degrees relative to the axis of rotation.

10. The system of claim 7 wherein further including a transition region between the first and second regions, wherein the transition region is one of a flare or at least one step.

11. A method of minimizing leakage flow in a turbine engine comprising the steps of:

providing a stationary turbine engine component with a seal operatively attached thereto; providing a turbine engine component rotating about an axis of rotation, the rotating turbine engine component having an outer peripheral surface that includes a first region at a first radius relative to the axis of rotation that transitions into a second region at a second radius relative to the axis of rotation, the second radius being greater than the first radius, the rotating turbine engine component further including a transition region between the first and second regions, wherein the transition region is a flare, the stationary and rotating turbine engine components define an interface, the interface being in a first position in which the seal is disposed over the first region so that a first clearance is defined therebetween; and selectively moving the interface into a second position in which the seal is disposed over the second region so that a second clearance is defined therebetween, the second clearance being less than the first clearance.

12. The method of claim 11 wherein the selectively moving step is performed upon the occurrence of a predetermined operational parameter.

13. The method of claim 12 wherein the operational parameter is steady state engine operation.

14. The method of claim 11 wherein the selectively moving step is performed by axially moving the stationary turbine engine component.

15. The method of claim 11 wherein the selectively moving step is performed by axially moving the rotating turbine engine component.

16. The method of claim 11 further including the step of selectively returning the interface to the first position.

17. The method of claim 11 wherein the seal is a brush seal.

* * * * *